US006464802B1

(12) United States Patent
Miyata et al.

(10) Patent No.: US 6,464,802 B1
(45) Date of Patent: Oct. 15, 2002

(54) HIGH CR STEEL PIPE FOR LINE PIPE

(75) Inventors: Yukio Miyata; Mitsuo Kimura; Takaaki Toyooka, all of Aichi (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/647,530

(22) PCT Filed: Feb. 1, 2000

(86) PCT No.: PCT/JP00/00533

§ 371 (c)(1),
(2), (4) Date: Oct. 2, 2000

(87) PCT Pub. No.: WO00/46415

PCT Pub. Date: Aug. 10, 2000

(30) Foreign Application Priority Data

Feb. 2, 1999 (JP) ..... 11-25432

(51) Int. Cl.[7] ..... C22C 38/40; C22C 38/42; C22C 38/48; C22C 38/50

(52) U.S. Cl. ..... 148/325; 420/34; 420/60; 420/70

(58) Field of Search ..... 420/34, 60, 70; 148/325

(56) References Cited

FOREIGN PATENT DOCUMENTS

| | | | |
|---|---|---|---|
| EP | 0 738 784 | | 10/1996 |
| JP | 57-5849 | * | 1/1982 |
| JP | 57-13152 | * | 1/1982 |
| JP | 5-163554 | | 6/1993 |
| JP | 7-150251 | * | 6/1995 |
| JP | 9-41092 | | 2/1997 |
| JP | 9-111345 | | 4/1997 |
| JP | 9-327721 | | 12/1997 |
| JP | 10-60599 | | 3/1998 |
| JP | 10-195607 | | 7/1998 |
| JP | 4-10330888 A | * | 12/1998 |
| JP | 11-47969 | | 2/1999 |
| JP | 11-323507 | | 11/1999 |
| JP | 2000-8144 | | 1/2000 |
| JP | 2000-24783 | | 1/2000 |

* cited by examiner

*Primary Examiner*—Deborah Yee
(74) *Attorney, Agent, or Firm*—Young & Thompson

(57) ABSTRACT

A high-Cr steel pipe for line pipes having further improved HAZ toughness and hot workability is provided by limiting the composition to:

C: 0.02% or less, Si: 0.5% or less, Mn: 0.2 to 3.0%, Cr: 10.0 to 14.0%, Ni: more than 2.0 to 3.0%, N: 0.02% or less, preferably Nb: 0.3% or less, and the balance being Fe and incidental impurities.

20 Claims, 2 Drawing Sheets

HIGH CR STEEL PIPE FOR LINE PIPE

TECHNICAL FIELD

The present invention relates to high-Cr steel pipes for line pipes which are used for transport of oil or natural gas, and which exhibit superior toughness at low temperatures.

BACKGROUND ART

In recent years, oil and natural gas wells which could be easily drilled have been exhaustively drilled, and wells in severe drilling environments, such as severely corrosive environments, deep wells, cold environments, and sea bottoms, have unwillingly start to be drilled.

Oil and natural gas produced from such wells contain large amounts of carbon dioxide gas in many cases, and low-carbon steel or low-alloy steel is significantly corroded in such environments. Thus, addition of inhibitors has been performed as an anticorrosion measure.

The use of inhibitors, however, increases cost and results in insufficient effects at high temperatures, and leakage thereof causes environmental contamination. Thus, corrosion resistant alloys (CRA) not requiring inhibitors have tended to be used recently. In oil tubular country goods (OCTG), martensitic stainless steel containing 13% of chromium (Cr) is widely used as such an CRA.

On the other hand, in line pipes, low-carbon martensitic stainless steel containing 12% Cr is defined in the API standard. This steel requires preheating and post welding heat treatment (PWHT) for girth welding, resulting in increased cost, and exhibits poor toughness at the welds. Thus, this steel has not substantially been employed as line pipes.

Accordingly, as a CRA for line pipe material, chromium-enriched duplex stainless steel containing nickel and molybdenum has been used due to the good weldability and corrosion resistance thereof.

A problem with duplex stainless steel, however, is excessive quality for some wells, resulting in increased cost.

In order to solve this problem, Japanese Unexamined Patent Application Publication No. 8-295939 discloses a method for making a high-Cr martensitic steel pipe for line pipes including forming a pipe from 10 to 14%-Cr steel and heat-treating this under specific conditions in which carbon (C) and nitrogen (N) are reduced to 0.03% or less and 0.02% or less, respectively, and copper (Cu) is adjusted to 0.2 to 1.0%. This method provides a steel pipe which is superior in corrosion resistance in a carbon dioxide gas environment, in weldability, and in heat-affected-zone (HAZ) toughness.

In this method, however, toughness is improved by heat treatment. Thus, the toughness is limited in the HAZ in which the heat treatment effects are lost, and the steel pipe does not satisfy requirements for higher toughness. Moreover, in the disclosed composition, the steel exhibits insufficient hot workability, and numerous defects occur in the production of seamless pipes.

An object of the present invention is to provide a high-Cr steel pipe for line pipes which exhibits further improved HAZ toughness and hot workability by the application of optical chemical composition, in view of the problems in the conventional art.

DISCLOSURE OF INVENTION

The present inventors have intensively studied in order to achieve the above object and have discovered that, as shown in FIG. 1, toughness at low temperatures is improved by decreasing carbon to 0.02% or less and increasing nickel from conventional 1.5% to more than 2.0%, that addition of Nb thereto improves toughness, and that this composition exhibits Heat-Affected-Zone (HAZ) toughness and hot workability which are significantly superior to those of conventional compositions. Herein, FIG. 1 shows the relationship between the yield strength (YS) and the fracture appearance transition temperature (50% FATT) obtained by the arrangement of the results of the tensile test and the Charpy impact test of steel pipes, which were made by followings; the raw materials having the compositions shown in the drawing was heated and was rolled to a seamless pipe of a diameter of 273 mm and a thickness of 13 mm, and the pipe was cooled in air to room temperature, was heated to the $Ac_3$ point or more for quenching, and was tempered at less than the $Ac_3$ point.

Pipelines are generally subjected to cathodic protection to prevent corrosion on the outer surface of steel pipes. Cathodic polarization of the steel pipes by sacrificial anodes such as Zn alloys or external power supply prevents the anodic reaction of iron. It is, however, feared that overprotection (a state of cathodic polarization at a potential which is more disnoble than a level required for protection) results in embrittlement due to hydrogen generated by the cathodic reaction. Thus, steel pipes require high resistance to hydrogen embrittlement, assuming that overprotection occurs by any cause.

The steel in accordance with the present invention does not occur hydrogen embrittlement cracks and exhibit high resistance to hydrogen embrittlement, as well as low-Ni materials (up to 2.0%) of comparative examples.

FIG. 2 shows the relationship between the amount of the permeated hydrogen and the Ni content when a hydrogen permeation test (the thickness of the test piece: 1.0 mm and the permeation area: 7 $cm^2$) is performed in a simulated environment of overprotection.

An increase in Ni to 2.0 to 3.0% causes a decrease in the amount of the permeated hydrogen. That is, resistance to hydrogen embrittlement is further improved. The steel No. agrees with the steel type shown in Table 1 in Examples.

The present invention, completed by further investigations based on these results, relates to a high-Cr steel pipe for line pipes having a composition comprising, by percent by weight:

C: 0.02% or less,

Si: 0.5% or less,

Mn: 0.2 to 3.0%,

Cr: 10.0 to 14.0%,

Ni: more than 2.0 to 3.0%,

N: 0.02% or less, and the balance being Fe and incidental impurities.

In the present invention, the composition preferably further comprises 0.3% or less of Nb.

In the present invention, the composition may further comprises at least one of the following (a) to (c):

(a) V: 0.3% or less, (b) Cu: 1.0% or less, and (c) at least one of Ti, Zr, and Ta in a total amount of 0.30% or less.

Figure 1:
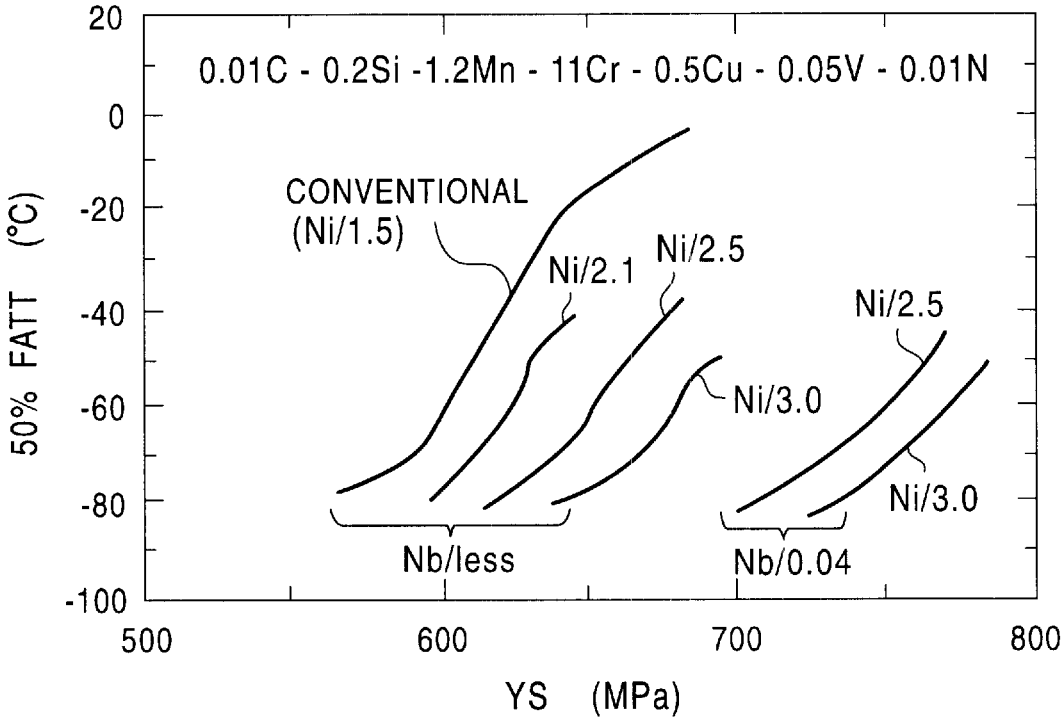
FIG. 1
Figure 2:
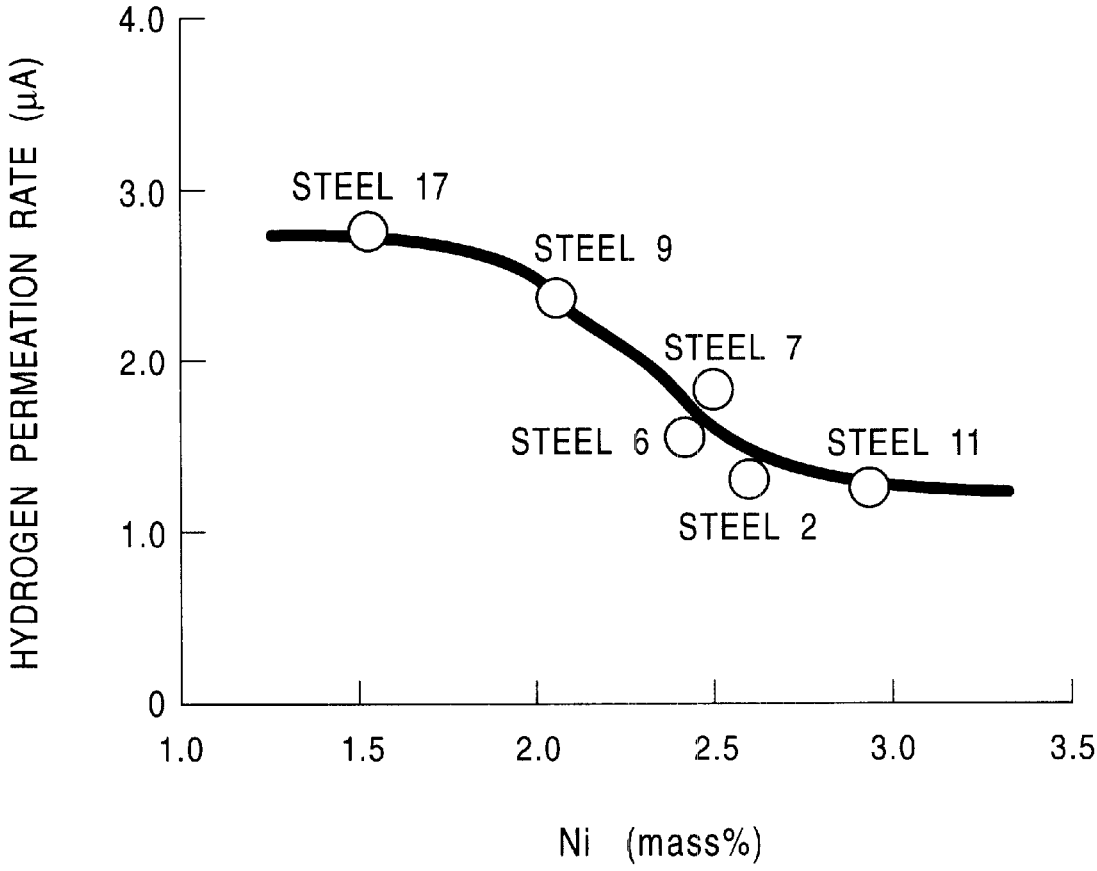

The relationship between the 50% FATT and the YS in 0.01C—0.2Si—1.2Mn—11Cr—Ni—0.5Cu—0.05V—0.01N steel

FIG. 2

The relationship between the amount of the permeated hydrogen and the Ni content Solution: artificial seawater Applied potential: −1,600 mV vs. SCE (saturated calomel electrode)

BEST MODE FOR CARRYING OUT THE INVENTION

The reasons for limiting the composition of the steel pipe in accordance with the present invention will now be described.

C: 0.02% or Less

It is preferable that C (Carbon) be reduced as much as possible for achieving reduced HAZ hardness, improved weld crack resistance, improved general corrosion resistance in environments containing carbon dioxide gas and chloride, and improved pitting corrosion resistance. In particular, a C content of 0.02% or less is essential for achieving welding without preheating. Thus, the upper limit of the C content is set to be 0.02%.

Preferably, the content is 0.015% or less to secure more satisfactory weldability.

Si: 0.5% or Less

Si (silicon) is added as a deoxidizer. Since it is a ferrite-forming element, a high content thereof promotes the formation of ferrite and causes deterioration of toughness of the base material and the HAZ. Moreover, the presence of the ferrite may preclude hot workability and thus production. Thus, the Si content is limited to be 0.5% or less. The content is preferably 0.3% or less.

Mn: 0.2 to 3.0%

Mn (manganese) acts as a deoxidizer and is an element contributing to increased strength. Since Mn is an austenite-forming element, this suppresses the formation of ferrite and improves the toughness of the base material and the HAZ. For achieving these effects, a content of 0.2% or more is necessary. Since the effects are saturated at a content exceeding 3.0%, the Mn content is limited to 0.2 to 3.0%. Preferably, the content is 1.0 to 2.0%.

Cr: 10.0 to 14.0%

Cr (chromium) is an essential element which secures a martensitic microstructure and enhances general corrosion resistance and pitting corrosion resistance in environments containing carbon dioxide gas. For achieving these effects, a content of 10.0% or more is necessary. A content exceeding 14.0% facilitates the formation of ferrite and requires large amounts of austenite-forming elements to secure stability of the martensitic microstructure and to prevent deterioration of hot workability, resulting in increased cost. Thus, the Cr content is set to be 10.0 to 14.0%.

Ni: More Than 2.0 to 3.0%

Ni (nickel) is an austenite-forming element, suppresses the formation of ferrite improves the toughness of the base material and the HAZ, and suppresses deterioration of hot workability. Moreover, this element improves general corrosion resistance and pitting corrosion resistance in environments containing carbon dioxide gas.

In addition, this element reduces the amount of hydrogen permeation in the steel in an overprotection state for cathodic protection and improves resistance to hydrogen embrittlement.

A content exceeding 2.0% must be added in order to improve the toughness of the HAZ in which the effects of heat treatment are lost compared to conventional pipes and to sufficiently secure hot workability. A content exceeding 3.0%, however, causes saturation of toughness and hot workability and is disadvantageous for increased cost. Thus, the Ni content is set to be more than 2.0 to 3.0%.

N: 0.02% or Less

It is preferable that N (nitrogen) be reduced as much as possible to avoid weld cracking, to improve the toughness of the HAZ, and to reduce the hardness of the HAZ, as in carbon. Since these effects are not sufficiently achieved at a content exceeding 0.02%, the content is limited to be 0.02% or less. Preferably, the content is 0.015% or less.

Nb: 0.3% or Less

Nb (niobium) has high affinity for C (carbon) and tends to form carbide. Thus, this element reduces the amount of chromium carbide in the presence of chromium and results in the effective amount of chromium which contributes to corrosion resistance, particularly, pitting corrosion resistance. Moreover, finely dispersed niobium carbide precipitates enhance the strength of the base material and the HAZ and improves toughness due to fine grain. Thus, it is preferable that niobium be positively added. At a content exceeding 0.3%, however, the pipe is sensitive for weld cracking and the improvement in toughness is saturated. Thus, the Nb content is preferably set to be a range of 0.3% or less. It is preferable that the content be 0.01 to 0.10% in view of the balance between strength and toughness.

V: 0.3% or Less

V (vanadium) is an element, which is useful in improvement in high-temperature strength, and may be added, if necessary. A content exceeding 0.3% increases strength causing deterioration of toughness. Thus, the V content is preferably in a range of 0.3% or less. It is preferable that the V content be 0.03 to 0.15% in view of improvement in high-temperature strength.

Cu: 1.0% or Less

Cu (copper) is also an austenite-forming element, in addition to Ni and Mn, suppresses the formation of ferrite, improves the toughness of the HAZ and general corrosion resistance, suppresses deterioration of hot workability, and stabilizes the passivation film in environments containing carbon dioxide gas and chlorides. Thus, copper may be added, if necessary. At a content exceeding 1.0%, copper is partly precipitated and adversely affects the toughness of the HAZ. Thus, the Cu content is preferably 1.0% or less. A preferable range in view of various effects is 0.2 to 1.0%.

At Least One of Ti, Zr, and Ta in a Total Amount of 0.30% or Less

Ti, Zr, and Ta tends to form carbides as in Nb, reduces chromium carbide, and increases the effective Cr content which contributes to corrosion resistance, particularly pitting corrosion resistance. Since these are also effective for improvement in toughness of the base material and the HAZ, these may be added alone or in combination. At a total content exceeding 0.30%, the pipe is sensitive for weld cracking and the toughness is decreased. Thus, the total content of these is preferably 0.30% or less. A preferable content is 0.01 to 0.2% for single use of Ti, 0.01 to 0.1% for single use of Zr, or 0.01 to 0.1% for single use of Ta, whereas the total content is preferably 0.03 to 0.2% in combined use.

Other elements are incidentally contained, and it is preferable that these elements be reduced as much as possible to secure the toughness of the base material. P (phosphorus), S (sulfur), and 0 (oxygen) can be contained up to 0.03%, 0.01%, and 0.01%, respectively.

A preferable production process of the steel pipe in accordance with the present invention will now be described.

Steel having the above composition is melted in a converter or an electric furnace, and is solidified by a continuous casting method or an ingot-making method. In these steps, the ladle refining and vacuum degassing of the molten steel may be performed, in necessary. This is used as a raw material for pipe after no additional treatment or after hot rolling.

The raw material is heated to the $Ac_3$ point or more, and is hot-rolled by a plug-mill or a mandrel-mill to form a seamless pipe. In addition, this may be further hot-rolled by a sizer or a hot stretch reducer into a desired size.

After the pipe rolling, the pipe is heat-treated to impart a desired strength-toughness balance. Regarding the heat treatment, one adaptable to target mechanical properties may be employed among quenching-tempering (Q-T), quenching-dual phase heat treatment-tempering (Q-Q'-T), quenching-dual phase heat treatment (Q-Q'), and dual phase heat treatment-tempering (Q'-T).

Quenching (Q) may be direct quenching (DQ) for immediately cooling the pipe from the hot state after the pipe rolling to the Ms point or less (approximately 200° C. or less), or reheating quenching (RQ) for reheating the pipe to an austenite region and then cooling to the Ms point or less (approximately 200° C. or less). In the present invention, a martensitic microstructure is obtained by quenching (Q) by normal air-cooling. Rapid cooling, such as air-blast cooling or water-cooling, however, can suppress growing the austenitic grains before martensitic transformation and improves toughness due to the fine microstrucure.

The dual phase heat treatment (Q') is a heat treatment for heating to a temperature region of the $Ac_1$ point or more ($Ac_1$ point+50° C.). Heating to the $Ac_1$ point or more makes a fine dual phase microstrucure of martensite and austenite. Since C and N have solubility in the martensitic phase than in the austenitic phase, these are diffused from the martensitic phase to the austenitic phase and are concentrated in the austenitic phase.

An austenitic phase containing concentrated C and N and a tempered martensitic phase containing diluted C and N are formed during the dual phase heat treatment (Q'), and a tempered martensitic phase containing large amounts of carbonitrides and a tempered martensitic phase containing significantly small amounts of carbonitrides and having significantly high grain boundary strength are formed by tempering (T) after the Q'. The formation of the tempered martensitic phase having significantly high grain boundary strength contributes to high toughness of the steel pipe.

When the Q' temperature exceeds the $Ac_1$ point+50° C., the fraction of the tempered martensitic phase containing diluted C and N which finally forms the tempered martensitic phase having high grain boundary strength is decreased, resulting in decreased improvement in toughness. Coarsening of grains also results in decreased improvement in toughness. The holding time of the Q' is preferably 10 to 60 minutes. Cooling after the holding is preferably performed at a cooling rate which is higher than that of air-cooling.

Tempering (T) is performed at less than the $Ac_1$ point and preferably at 550° C. or more. After heating at this temperature, the pipe is cooled at a cooling rate higher than air-cooling rate. The texture thereby contains a tempered martensitic phase containing small amounts of carbonitrides and having high grain boundary strength and the resulting pipe has high toughness. The holding time of the T is preferably 10 to 60 minutes.

EXAMPLES

Each of steels having the composition shown in Table 1 was melted in a converter, was degassed under vacuum, and was solidified by a continuous casting process to form a cast slab, and the resulting cast slab was billet-milled to form a raw material for steel pipe. Using the raw material, a seamless steel pipe with a diameter of 273 mm and a thickness of 13 mm was produced by a Mannesmann plug mill. The formation of defects on the pipe surface was inspected. Moreover, the steel pipe was heat-treated. under the conditions shown in Table 2, and test pieces were sampled from the parent steel pipe in which the YS is adjusted to approximately 600 MPa to measure tensile properties, toughness at low temperatures, and corrosion resistance (general corrosion resistance and pitting corrosion resistance). In addition, a welded joint was made from the parent steel pipe by TIG welding (voltage: 15 V, current: 200 A, welding rate: 10 cm/min, and heat input: 18 kJ/cm) using duplex stainless steel as a welding material, and the toughness at low temperatures of the HAZ (1 mm from the bond) was measured.

The tensile test was performed according to ASTM 370.

The toughness at low temperatures was evaluated by a Charpy impact test, as ◎ for −70° C. or less, ○ for −70° C. to −60° C., or×(not good) for the rest, of a fracture. appearance transition temperature (50% FATT).

The corrosion test was performed by a carbon dioxide gas corrosion test method in which a test piece of 3.0 mm×25 mm×50 mm was immersed in an aqueous 20%-NaCl solution saturated with 3.0 MPa carbon dioxide gas in an autoclave at 80° C. for 7 days.

The general corrosion resistance was determined by the weight of the test piece which was subjected to the corrosion test, water washing, and then drying, and the weight loss rate was converted to a thickness reduction per year. The thickness reduction per year was evaluated as ○ for less than 0.1 mm/year or×for the rest.

The pit corrosion resistance was evaluated by visual observation of the surface of the test piece which as washed with water and dried after the corrosion test, as for pitting corrosion of at least one position or ○ for the rest.

In Examples in accordance with the present invention, no pit corrosion is observed, the thickness reduction is less than 0.1 mm/year, showing high pitting corrosion resistance and general corrosion resistance of practical levels, no defect caused by pipe rolling is observed, and the toughness of the base material toughness and the HAZ is superior. These characteristics are sufficient for line pipes. In contrast, in Comparative Examples outside of the present invention, the HAZ toughness and defects caused by pipe rolling are inferior to Examples in accordance with the present invention.

TABLE 1

| Steel | Composition (percent by weight) | | | | | | | | | | | | | | | $Ac_1$ point | $Ac_3$ point | |
|---|---|---|---|---|---|---|---|---|---|---|---|---|---|---|---|---|---|---|
| No. | C | Si | Mn | Cr | Ni | N | Nb | V | Cu | Ti | Zr | Ta | P | S | O | ° C. | ° C. | Remarks |
| 1 | 0.012 | 0.41 | 1.51 | 11.8 | 2.7 | 0.010 | — | — | — | — | — | — | 0.023 | 0.0031 | 0.0034 | 650 | 780 | Example of present invention |
| 2 | 0.005 | 0.21 | 1.83 | 10.8 | 2.6 | 0.008 | 0.213 | — | — | — | — | — | 0.014 | 0.0041 | 0.0029 | 670 | 800 | Example of present invention |
| 3 | 0.007 | 0.19 | 1.21 | 11.1 | 2.4 | 0.010 | — | 0.185 | — | — | — | — | 0.019 | 0.0013 | 0.0015 | 660 | 785 | Example of present invention |
| 4 | 0.011 | 0.22 | 2.25 | 13.3 | 2.3 | 0.011 | 0.063 | 0.081 | — | — | — | — | 0.015 | 0.0023 | 0.0022 | 665 | 790 | Example of present invention |
| 5 | 0.013 | 0.03 | 1.13 | 12.0 | 2.5 | 0.008 | — | — | 0.75 | — | — | — | 0.020 | 0.0008 | 0.0013 | 660 | 790 | Example of present invention |
| 6 | 0.009 | 0.20 | 1.25 | 10.9 | 2.4 | 0.011 | 0.021 | — | 0.51 | — | — | — | 0.018 | 0.0025 | 0.0026 | 665 | 795 | Example of present invention |
| 7 | 0.010 | 0.25 | 1.25 | 11.3 | 2.5 | 0.008 | — | 0.071 | 0.43 | — | — | — | 0.016 | 0.0017 | 0.0031 | 660 | 780 | Example of present invention |
| 8 | 0.008 | 0.15 | 1.75 | 10.9 | 2.2 | 0.009 | 0.038 | 0.045 | 0.63 | — | — | — | 0.017 | 0.0015 | 0.0028 | 665 | 785 | Example of present invention |
| 9 | 0.011 | 0.015 | 1.41 | 10.8 | 2.1 | 0.012 | — | — | — | — | 0.081 | — | 0.025 | 0.0051 | 0.0013 | 670 | 790 | Example of present invention |
| 10 | 0.009 | 0.20 | 1.63 | 11.2 | 2.4 | 0.017 | 0.083 | — | — | 0.091 | 0.032 | 0.044 | 0.014 | 0.0018 | 0.0025 | 670 | 790 | Example of present invention |
| 11 | 0.012 | 0.26 | 1.33 | 12.1 | 2.9 | 0.008 | 0.042 | 0.091 | — | — | — | 0.031 | 0.019 | 0.0022 | 0.0035 | 655 | 780 | Example of present invention |
| 12 | 0.010 | 0.22 | 1.50 | 11.3 | 2.6 | 0.009 | — | 0.038 | 0.47 | 0.071 | — | — | 0.022 | 0.0018 | 0.0039 | 660 | 790 | Example of present invention |
| 13 | 0.025 | 0.23 | 2.12 | 10.9 | 2.2 | 0.012 | — | — | 0.41 | — | — | — | 0.017 | 0.0023 | 0.0029 | 670 | 790 | Example of present invention |
| 14 | 0.011 | 0.81 | 1.13 | 12.1 | 2.3 | 0.013 | — | 0.051 | — | 0.071 | — | — | 0.023 | 0.0019 | 0.0030 | 675 | 800 | Example of present invention |
| 15 | 0.012 | 0.18 | 1.51 | 9.6 | 2.5 | 0.012 | 0.041 | 0.047 | 0.47 | 0.081 | — | — | 0.020 | 0.0020 | 0.0032 | 660 | 785 | Example of present invention |
| 16 | 0.009 | 0.29 | 1.52 | 14.4 | 2.3 | 0.009 | 0.056 | — | 0.67 | — | — | — | 0.018 | 0.0039 | 0.0037 | 710 | 830 | Comparative example |
| 17 | 0.013 | 0.14 | 1.75 | 12.1 | 1.5 | 0.008 | 0.031 | 0.061 | — | 0.065 | 0.071 | — | 0.021 | 0.0041 | 0.0033 | 700 | 800 | Comparative example |
| 18 | 0.012 | 0.22 | 1.20 | 11.2 | 2.2 | 0.025 | — | — | — | — | — | 0.051 | 0.019 | 0.0029 | 0.0035 | 670 | 795 | Comparative example |
| 19 | 0.009 | 0.28 | 2.24 | 11.7 | 2.5 | 0.011 | — | 0.038 | 1.3 | — | — | — | 0.023 | 0.0022 | 0.0034 | 660 | 785 | Comparative example |
| 20 | 0.010 | 0.34 | 1.39 | 11.2 | 2.5 | 0.011 | 0.023 | 0.041 | — | 0.353 | — | — | 0.013 | 0.0025 | 0.0039 | 665 | 790 | Comparative example |
| 21 | 0.008 | 0.25 | 1.58 | 11.5 | 2.6 | 0.011 | — | 0.034 | 0.33 | 0.173 | 0.081 | 0.072 | 0.025 | 0.0018 | 0.0029 | 665 | 790 | Comparative example |

TABLE 2

| No. | Steel No. | Rolling defect | Heat treatment condition DQ(c) [orRQ(t c)]-Q'(t c)-T (t); t: Temp. ° C., c: Cooling (A: Air cooling, W: Water cooling) | Parent material YS MPa | Parent material TS MPa | Parent material 50% FATT | HAZ 50% FATT | Pitting corrosion | General corrosion | Remarks |
|---|---|---|---|---|---|---|---|---|---|---|
| 1 | 1 | Not | DQ(A)-Q'(690W)-T(640) | 615 | 753 | ⊚ | ⊚ | ○ | ○ | Example of present |
| 2 | 2 | Not | RQ(W)-T(650) | 618 | 740 | ○ | ○ | ○ | ○ | Example of present |
| 3 | 3 | Not | RQ(A)-Q'(700W)-T(640) | 605 | 738 | ○ | ○ | ○ | ○ | Example of present |

TABLE 2-continued

| No. | Steel No. | Rolling defect | Heat treatment condition DQ(c) [orRQ(t c)]-Q'(t c)-T (t); t: Temp. ° C., c: Cooling (A: Air cooling, W: Water cooling) | Parent material YS MPa | Parent material TS MPa | Parent material 50% FATT | HAZ 50% FATT | Pitting corrosion | General corrosion | Remarks |
|---|---|---|---|---|---|---|---|---|---|---|
| 4 | 4 | Not | DQ(W)-Q'(690W)-T(645) | 597 | 736 | ○ | ○ | ○ | ○ | Example of present |
| 5 | 5 | Not | DQ(W)-Q'(690A)-T(640) | 596 | 738 | ◎ | ◎ | ○ | ○ | Example of present |
| 6 | 6 | Not | RQ(A)-Q'(680A) | 592 | 742 | ◎ | ◎ | ○ | ○ | Example of present |
| 7 | 7 | Not | DQ(A)-T(650) | 615 | 740 | ◎ | ◎ | ○ | ○ | Example of present |
| 8 | 8 | Not | DQ(A)-Q'(690A)-T(640) | 601 | 735 | ◎ | ◎ | ○ | ○ | Example of present |
| 9 | 9 | Not | RQ(A)-T(650) | 620 | 741 | ○ | ○ | ○ | ○ | Example of present |
| 10 | 10 | Not | RQ(W)-T(650) | 618 | 737 | ◎ | ◎ | ○ | ○ | Example of present |
| 11 | 11 | Not | RQ(W)-Q'(680W)-T(640) | 603 | 729 | ◎ | ◎ | ○ | ○ | Example of present |
| 12 | 12 | Not | RQ(A)-Q'(690A)-T(640) | 596 | 711 | ◎ | ◎ | ○ | ○ | Example of present |
| 13 | 1 | Not | DQ(A)-Q'(740W)-T(640) | 618 | 755 | ○ | ○ | ○ | ○ | Example of present |
| 14 | 13 | Not | RQ(A)-Q'(700A)-T(650) | 610 | 748 | x | x | ○ | ○ | Comparative example |
| 15 | 14 | Observed | RQ(A)-T(650) | 618 | 751 | x | x | ○ | ○ | Comparative example |
| 16 | 15 | Not | RQ(A)-T(640) | 603 | 736 | ○ | ○ | x | x | Comparative example |
| 17 | 16 | Observed | RQ(W)-T(680) | 599 | 728 | x | x | ○ | ○ | Comparative example |
| 18 | 17 | Observed | RQ(A)-T(680) | 604 | 727 | x | x | ○ | ○ | Comparative example |
| 19 | 17 | Observed | RQ(A)-Q'(720A)-T(670) | 609 | 733 | ○ | x | ○ | ○ | Comparative example |
| 20 | 18 | Not | DQ(A)-Q'(700A)-T(650) | 617 | 739 | x | x | ○ | ○ | Comparative example |
| 21 | 19 | Not | DQ(W)-Q'(690A)-T(640) | 615 | 730 | x | x | ○ | ○ | Comparative example |
| 22 | 20 | Not | RQ(A)-Q'(700A)-T(650) | 613 | 729 | x | x | ○ | ○ | Comparative example |
| 23 | 21 | Not | RQ(W)-Q'(690W)-T(650) | 609 | 718 | x | x | ○ | ○ | Comparative example |

Industrial Applicability

The steel pipe in accordance with the present invention exhibits superior pitting corrosion resistance and general corrosion resistance in environments containing carbon dioxide gas and chlorides, superior base material toughness and HAZ toughness, and no defect caused by pipe rolling. Thus, the steel pipe can be provided as line pipe materials for transport of oil and natural gas at low cost and has significant industrial advantages.

What is claimed is:

1. A high-Cr steel seamless pipe for line pipes, the pipe having a composition consisting essentially of, by percent by weight:

C: 0.02% or less,

Si: 0.5% or less,

Mn: 0.2 to 3.0%,

Cr: 10.0 to 14.0%,

Ni: more than 2.0 to 3.0%,

N: 0.02% or less, and the balance being Fe and incidental impurities, wherein the pipe has a seamless cross section through its length and a yield strength of more than 590 MPa to 770 MPa.

2. The high-Cr steel seamless pipe according to claim 1, wherein the pipe has a yield strength of more than 592 MPa to 620 MPa.

3. The high-Cr steel seamless pipe according to claim 1, wherein the pipe has a hydrogen permeation rate of less than 2.3 $\mu$A with a permeation area of 7 $cm^2$ and an applied potential of −1,600 mV vs. SCE.

4. The high-Cr steel seamless pipe according to claim 1, wherein the composition further comprises 0.3% or less of Nb.

5. The high-Cr steel seamless pipe according to claim 1, wherein the composition further comprises 0.3% or less of V.

6. The high-Cr steel seamless pipe according to claim 4, wherein the composition further comprises 0.3% or less of V.

7. The high-Cr steel seamless pipe according to claim 1, wherein the composition further comprises 1.0% or less of Cu.

8. The high-Cr steel seamless pipe according to claim 4, wherein the composition further comprises 1.0% or less of Cu.

9. The high-Cr steel seamless pipe according to claim 5, wherein the composition further comprises 1.0% or less of Cu.

10. The high-Cr steel seamless pipe according to claim 1, wherein the composition further comprises at least one of Ti, Zr, and Ta in a total amount of 0.30% or less.

11. The high-Cr steel seamless pipe according to claim 4, wherein the composition further comprises at least one of Ti, Zr, and Ta in a total amount of 0.30% or less.

12. The high-Cr steel seamless pipe according to claim 5, wherein the composition further comprises at least one of Ti, Zr, and Ta in a total amount of 0.30% or less.

13. The high-Cr steel seamless pipe according to claim 2, wherein the composition further comprises 0.3% or less of Nb.

14. The high-Cr steel seamless pipe according to claim 3, wherein the composition further comprises 0.3% or less of Nb.

15. The high-Cr steel seamless pipe according to claims 2, wherein the composition further comprises 0.3% or less of V.

16. The high-Cr steel seamless pipe according to claim 3, wherein the composition further comprises 0.3% or less of V.

17. The high-Cr steel seamless pipe according to claim 2, wherein the composition further comprises 1.0% or less of Cu.

18. The high-Cr steel seamless pipe according to claim 3, wherein the composition further comprises 1.0% or less of Cu.

19. The high-Cr steel seamless pipe according to claim 2, wherein the composition further comprises at least one of Ti, Zr, and Ta in a total amount of 0.30% or less.

20. The high-Cr steel seamless pipe according to claim 3, wherein the composition further comprises at least one of Ti, Zr, and Ta in a total amount of 0.30% or less.

* * * * *